United States Patent [19]

Leveque

[11] 4,357,182

[45] Nov. 2, 1982

[54] CHROMIZATION OF STEELS BY GAS PROCESS

[75] Inventor: Robert Leveque, Firminy, France

[73] Assignee: Creusot-Loire, Paris, France

[21] Appl. No.: 258,822

[22] Filed: Apr. 29, 1981

[30] Foreign Application Priority Data

May 29, 1980 [FR] France ..... 80 11950

[51] Int. Cl.[3] ..... C23C 11/10

[52] U.S. Cl. ..... 148/6.35; 148/16.6; 204/177; 427/38; 427/253

[58] Field of Search ..... 427/38, 39, 252, 253, 427/249, 255.4, 328; 148/6.35, 16.6; 204/192 N, 164, 177

[56] References Cited

U.S. PATENT DOCUMENTS

| | | | |
|---|---|---|---|
| 3,190,772 | 6/1965 | Berghaus et al. | 148/16.6 |
| 3,282,746 | 11/1966 | Zlotek et al. | 427/252 |
| 3,730,863 | 5/1973 | Keller | 204/177 |
| 4,242,151 | 12/1980 | Leveque | 148/16.6 |
| 4,250,208 | 2/1981 | Arai | 148/6.35 |

*Primary Examiner*—John P. Sheehan

*Attorney, Agent, or Firm*—Pollock, Vande Sande & Priddy

[57] ABSTRACT

A process for the chromization by gas of steels containing more than 0.2% of carbon, consisting of three successive treatments, the chromization treatment proper employing a cement having a ferrochrome base containing between 1% and 3% of carbon, and preferably 2%. The process is particularly useful in the chromization of structural and tool steels.

5 Claims, No Drawings

CHROMIZATION OF STEELS BY GAS PROCESS

FIELD OF THE INVENTION

The present invention refers to an improvement in the chromization by gas process of steel containing more than 0.2% of carbon, more especially structural steels and tool steels.

BACKGROUND

In U.S. Pat. No. 4,242,151, the applicants described a method of chromization in three successive periods set up preferably as follows:

1. An ionic nitriding at a temperature lying between 450° and 650° C., employing a reactive atmosphere of nitrogen and hydrogen at a partial pressure of nitrogen at most equal to 1.5 millibars and at a total gas pressure lying between 2 and 10 millibars.
2. A chromization at a temperature lying between 900° and 1000° C. with a cement consisting of ferrochrome with a chromium content running from 50 up to 75% and the grain size of which lies between 0.5 and 4 mm, without any aluminous or magnesian binder, mixed with a halogenide.
3. A heat treatment by soaking at a temperature lying between 800° and 1000° C. and tempering between 580° and 650° C. depending upon the level of resistance required for the substrate.

It is thus possible substantially to increase the thickness of high-hardness chromized layers in the case of alloy steels containing more than 0.2% of carbon. That is, thanks to this innovation, it is possible to achieve layers of thickness equal to 50 microns whereas in the best case conventional chromidation enables one to reach 20 microns. On the other hand, the innovation in accordance with the previous patent is of equal interest to the structure of the layers:

in conventional chromization the coatings consist of two types of carbides: $M_{23}C_6$, richer in chromium, towards the surface, and $M_7C_3$, poorer in chromium, towards the metal substrate.

as a result of the treatment in three stages, which forms the object of the previous patent, the coatings consist essentially of chromium carbonitride $Cr_2(C,N)$, of which the very high chromium content (Cr lying between 75 and 85%), the high level of hardness, lying between 2000 and 2500 Vickers (at 50 grammes) and the hexagonal structure with the base plane of the mesh directed in parallel with the surface of the substrate, form of it a compound which is particularly interesting for any problem where one is looking for high resistance to both corrosion, friction and wear.

However, under the operational conditions described in the previous patent, the obtaining of monophase layers of $Cr_2(C,N)$ may be tricky in certain cases because of too heavy an application of chromium on the surface with respect to the flow of nitrogen proceeding from the substrate which has undergone the first phase of ionic nitriding. The result is that, along the seams of the basaltic formations of $Cr_2(C,N)$ there is formed locally the carbide $M_{23}C_6$, and the presence in the coating of this second compound has several disadvantages:

substantial increase in surface roughness;

increase of the risk of starting fissures at the interface between the two constituents $M_{23}C_6$ and $Cr_2(C,N)$, whence the possibility of scaling and localized corrosion.

SUMMARY OF THE INVENTION

The aim of the present invention is the achievement of monophase layers of $Cr_2(C,N)$ by a reduction in the surface application of chromium.

For this purpose the object of the invention is an improvement in the method of chromization by gas process of steels containing more than 0.2% of carbon, consisting of three successive treatments in accordance with the previous patent, this improvement having as its aim a reduction in the surface application of chromium, and being characterized in that in the chromization treatment by gas employing a cement having a ferrochrome base with 50%/75% of chromium, with a grain size lying between 0.5 mm and 4 millimeters, a ferrochrome is chosen the carbon content of which lies between 1% and 3%, and is preferably close to 2%.

In accordance with a particular characteristic of the invention, which is applicable only to steels the carbon content of which lies between 0.20% and 0.35%, the cement employed in the chromization treatment by gas consists of a powdery mixture of a ferrochrome powder which exhibits a chromium content lying between 50% and 75%, a carbon content lying between 1% and 3%, and a grain size lying between 0.5 mm and 4 millimeters, without any aluminous or magnesium binder, and an ammonium chloride powder, this latter powder occurring in the said powdery mixture in a concentration lying between 0.5% and 1.5%.

In accordance with another particular characteristic of the invention which is applicable only to steels the carbon content of which is higher than 0.35%, the cement employed in the chromization treatment by gas consists of a powdery mixture of the same ferrochrome powder as above, and a powder of magnesium chloride or of ammonium fluoride, this latter powder occurring in the said powdery mixture in a concentration lying between 0.5% and 1.5%.

As may be understood, the main improvement introduced by the present invention with respect to the previous patent consists in employing only ferrochromes the carbon content of which lies between 1% and 3%, and preferably is close to 2%. This presence of the carbon in the ferrochrome enables a layer to be obtained in chromization by gas, which is perfectly monophase in carbonitrides of chromium $Cr_2(C,N)$, and the formation of carbides $M_{23}C_6$ to be avoided (M designating a metal such as iron (Fe), chromium (Cr), nickel (Ni), etc.).

A secondary improvement in accordance with the present invention with respect to the previous patent consists, for steels having a carbon content lying between 0.2% and 0.35%, while keeping to ammonium chloride as the halogenide, in employing it in a slightly increased concentration, lying between 0.5% and 1.5%, instead of 0.4% to 1%.

Another improvement in accordance with the present invention with respect to the previous patent consists, for steels having a carbon content higher than 0.35%, in replacing the ammonium chloride either by magnesium chloride or by ammonium fluoride, which are more stable halogenides than ammonium chloride.

DETAILED DESCRIPTION OF EXAMPLES

In order that the method in accordance with the present invention be more clearly understood, with a view to achieving monophase layers of $Cr_2(C,N)$, here are two examples relative to two steels which by their carbon content are situated on opposite sides of the limit of 0.35% previously defined.

The first example relates to a chromium-molybdenum-vanadium steel of type 32 CDV 13, hence containing 0.32% of carbon. This steel has undergone the first sequence of ionic nitriding under the conditions previously defined and more precisely between 520° and 530° C., for 30 hours at a partial pressure of nitrogen lying between 0.1 and 0.5 millibars, the working pressure lying between 2.5 and 8 millibars. Under these conditions the average content of nitrogen in the steel between 50 and 200 microns in depth reaches 2.1% and the nitrided layer does not contain any nitrides of iron or nitrides of chromium.

The 32 CDV 13 steel sample thus nitrided is introduced into a cementation box in which the second phase of the treatment is going to be effected, which is a chromization by gas. The cementation agent consists of 99% of ferrochrome containing 65/70% of chromium and 2% of carbon, the average grain size of which is close to 2.7 mm (extremes: 0.5 and 4 mm) and 1% of ammonium chloride which upon the temperature rising, is going to decompose in order to yield the active vapour of chromium chloride $CrCl_2$. The enclosure is brought to an average temperature of 950° C. for a period of 15 hours and the subsequent heat treatment of the piece of steel is carried out immediately after the chromization phase. Under these conditions a perfectly monophase layer is obtained of carbonitrides of chromium $Cr_2(C,N)$ the thickness of which is about 50 microns. The characteristics of this layer are as follows:

hardness close to 2500Hv on the Vickers scale under a load of 50 grams;

very homogeneous chemical composition throughout its whole thickness with: 77% Cr, 10% Fe, 10% $N_2$ and 3% C;

basaltic structure with the basalt plane directed in parallel with the base plane of the hexagonal mesh;

very good surface roughness with a RT less than 4 microns (the RT is a parameter which characterizes the surface roughness of a surface by the distance which separates the highest reliefs from the deepest hollows observed on the recording);

absence of defects or porosities between the basalts of $CR_2(C,N)$.

Such a structure is obviously very favorable for any problem in which one is looking for both:

good resistance to corrosion (given by the chromium content and the absence of surface defects);

good resistance to friction and wear (given by the hardness of the compound, its crystallographic structure and the surface roughness).

The second example relates to a chromium-molybdenum-vanadium steel of type 40 CDV 12, hence containing 0.40% of carbon. This steel has undergone the first sequence of ionic nitriding under the conditions which have been stated clearly during the description of the first example.

The 40 CDV 12 steel sample thus nitrided is introduced into a cementation box in which the second phase of the treatment is going to be effected, which is a chromization by gas. The cementation agent consists of 99% of ferrochrome containing 65/70% of chromium and 2% of carbon, the average grain size of which is close to 2.7 mm (extremes: 0.5 and 4 mm) and 1% of magnesium chloride which, when the temperature rises, will decompose in order to yield the active vapor of chromium chloride $CrCl_2$.

The enclosure is brought to an average temperature of 950° C. for a period of 15 hours, and the subsequent heat treatment of the piece of steel is carried out immediately after the chromization phase. Under these conditions a perfectly monophase layer is obtained of carbonitrides of chromium $Cr_2(C,N)$ the thickness of which is about 40 microns and the characteristics of which are the same as those which have been described in the first example.

I claim:

1. Method of chromization of steels containing more than 0.2% carbon, comprising the successive steps of (a) ionic nitriding of a surface layer having a thickness in the range of 100 to 350 microns, carried out in an atmosphere consisting of a mixture of nitrogen and hydrogen at a temperature in the range of 450° to 650° C. for a period in the range of 5 to 40 hours, so as to obtain between 1.5% and 2.5% of nitrogen in the nitrided layer;

(b) chromization by gas, of a duration in the range of 5 to 30 hours and carried out at temperatures in the range of 850° to 1100° C., said chromization employing a cement having a ferrochrome base with a chromium content in the range of 50% to 75% with a grain size in the range of 0.5 mm to 4 mm, the ferrochrome having a carbon content of 1% to 3%; and (c) heat treatment comprising an oil quenching of the chromized piece, followed by tempering at a temperature in the range of 600° to 650° C., of a duration in the range of 30 minutes to 10 hours.

2. Method according to claim 1, applicable to steels the carbon content of which is in the range of 0.20% to 0.35%, wherein said cement consists of a powdery mixture of a ferrochrome powder having a chromium content in the range of 50% to 75%, a carbon content in the range of 1% to 3%, and a grain size in the range of 0.5 mm to 4 mm, free of aluminous or magnesian binder, and an ammonium chloride powder in said powdery mixture in a concentration in the range of 0.5% to 1.5%.

3. Method according to claim 1, applicable to steels the carbon content of which is higher than 0.35%, wherein said cement consists of a powdery mixture of a ferrochrome powder having a chromium content in the range of 50% to 75%, a carbon content in the range of 1% to 3%, and a grain size in the range of 0.5 mm to 4 mm, and a magnesium chloride powder in said powdery mixture in a concentration in the range of 0.5% to 1.5%.

4. Method according to claim 1, applicable to steels the carbon content of which is higher than 0.35%, wherein said cement consists of a powdery mixture of a ferrochrome powder having a chromium content in the range of 50% to 75%, a carbon content in the range of 1% to 3%, and a grain size in the range of 0.5 mm to 4 mm, and an ammonium fluoride powder in said powdery mixture in a concentration in the range of 0.5% to 1.5%.

5. Method according to any one of claims 1 to 4, wherein said ferrochrome employed in said chromization treatment by gas has a carbon content of 2%.

* * * * *